US007841467B2

(12) United States Patent
Slayton

(10) Patent No.: US 7,841,467 B2
(45) Date of Patent: Nov. 30, 2010

(54) PORTABLE STORAGE DEVICE WITH BAT HOLDER

(76) Inventor: John Slayton, 525 S. Newman Rd., Lake Orion, MI (US) 48362

( * ) Notice: Subject to any disclaimer, the term of this patent is extended or adjusted under 35 U.S.C. 154(b) by 0 days.

(21) Appl. No.: 12/364,627

(22) Filed: Feb. 3, 2009

(65) Prior Publication Data

US 2010/0039008 A1 Feb. 18, 2010

Related U.S. Application Data

(60) Provisional application No. 61/088,429, filed on Aug. 13, 2008.

(51) Int. Cl.
*B65D 85/00* (2006.01)

(52) U.S. Cl. ..... 206/315.1; 206/315.9; 206/579

(58) Field of Classification Search ..... 206/315.1, 206/315.9, 315.11, 579; 211/14, 75, 87.7, 211/88; 190/107–113; 383/38–40; 312/3–6
See application file for complete search history.

(56) References Cited

U.S. PATENT DOCUMENTS 2,517,757 A * 8/1950 Adlerstein ..... 312/3
3,698,563 A * 10/1972 Gordon et al. ..... 211/85.7
4,491,258 A * 1/1985 Jones ..... 224/153
4,693,402 A 9/1987 Comeau
5,337,907 A * 8/1994 McKenzie et al. ..... 383/39
5,588,529 A * 12/1996 Speck ..... 206/315.1
6,009,995 A * 1/2000 Speck ..... 206/315.9
6,561,329 B2 5/2003 Stobbs, II et al.
6,595,358 B1 7/2003 Speck
6,659,273 B1 * 12/2003 Scola ..... 206/285
7,278,539 B2 * 10/2007 Souza ..... 206/315.1
7,416,065 B2 * 8/2008 Levinson et al. ..... 190/109
7,559,423 B2 * 7/2009 Vosloo ..... 206/315.1
7,604,102 B2 * 10/2009 Albritton ..... 190/107
2005/0052100 A1 * 3/2005 Horning ..... 211/14
2007/0119883 A1 5/2007 Albritton
2007/0227922 A1 10/2007 Chappell et al.
2008/0277362 A1 * 11/2008 White ..... 211/85.7
2009/0188819 A1 * 7/2009 Carney et al. ..... 206/315.1

* cited by examiner

*Primary Examiner*—Bryon P Gehman
(74) *Attorney, Agent, or Firm*—Brooks Kushman P.C.

(57) ABSTRACT

A portable storage device having a storage device body including a generally resilient shelf and flexible material partially surrounding the shelf and a connector attached to the flexible material, the connector having a hook and being configured to connect the storage device body to a support member in a manner that supports the shelf in a generally horizontal orientation. The portable storage device may also include a collapsible compartment suspended from the shelf to provide additional storage accommodations.

20 Claims, 6 Drawing Sheets

PORTABLE STORAGE DEVICE WITH BAT HOLDER

CROSS-REFERENCE TO RELATED APPLICATIONS

This application claims the benefit of U.S. Provisional Application Ser. No. 61/088,429, filed Aug. 13, 2008. The above-referenced patent application is incorporated herein by reference.

BACKGROUND OF THE INVENTION

1. Field of the Invention

Embodiments of the present invention relate to a portable storage device including, but not limited to, collapsible sports lockers for safely and securely storing equipment such as sporting equipment when not in use.

2. Background Art

Sports, such as, but not limited to, baseball, utilize a variety of different equipment during game play. The sport may require the use of some pieces of equipment at designated times and other pieces of equipment at alternate times. For instance, when a baseball team is "in the field", the players do not need batting helmets or baseball bats. Conversely, when the baseball team is "at bat", the players do not need their baseball gloves. The frequent exchange of equipment during a baseball game can result in a disorganized dugout area with equipment strewn on floor and seating surfaces. The similarity in appearance of the player's equipment may cause confusion among the players as to which piece of equipment belongs to which player. Additionally, the placement of equipment on seating surfaces and floor surfaces can damage the equipment and potentially injure the players. These problems are not unique to the sport of baseball but rather arise in other sports as well. It would therefore be advantageous for the individual sport's player to have a portable locker or other portable storage device for their equipment and apparel that can quickly and easily be deployed for use and then retrieved and stored for transport to and from the game. The present invention addresses these and other problems.

SUMMARY OF THE INVENTION

Various embodiments of a portable storage device are disclosed herein. In a first embodiment, a portable storage device for use with a support member comprises a storage device body including a generally resilient shelf and a flexible material at least partially surrounding the shelf. The portable storage device further comprises a first connector attached to the flexible material. The first connector includes a hook and is configured to removably connect the storage device body to the support member and to support the shelf in a generally horizontal orientation when the first connector engages the support member.

In an implementation of the first embodiment, the portable storage device further comprises a second connector attached to the flexible material at a location that is spaced apart from the first connector. The second connector includes a hook and is configured to removably connect the storage device body to the support member. The second connector cooperates with the first connector to support the storage device body in a generally horizontal orientation when the first connector and the second connector engage the support member.

In another implementation of the first embodiment, the first connector comprises an S-hook.

In another implementation of the first embodiment, the first connector comprises a closable hook.

In another implementation of the first embodiment, the portable storage device further comprises a first tether member having a first end and a second end. The first end of the first tether member is attached to the flexible material and the second end of the first tether member is attached to the first connector. The first tether member and the first connector cooperate to support the storage device body in a generally horizontal orientation when the first connector engages the support member. In a variation of this implementation, the portable storage device further comprises a second connector that is configured for removable attachment to the support member and a second tether member having a first end and a second end. The first end of the second tether member is attached to the flexible material at a location that is spaced apart from the first tether member. The second end of the second tether member is attached to the second connector. The second connector and the second tether member cooperate with the first connector and the first tether member to support the storage device body in a generally horizontal orientation when the first connector and the second connector engage the support member.

In a second embodiment, a portable storage device comprises a compartment having a floor member, a ceiling member spaced apart from the floor member, a first wall member attached to both the floor member and the ceiling member, and a second wall member that is attached to both the floor member and the ceiling member. The second wall member is spaced apart from the first wall member. The portable storage device further comprises a first connector that is connected to the compartment. The first connector is configured to be removably connected to a support member. In this second embodiment, the ceiling member comprises a resilient first member. The compartment can move between an expanded position to receive items for storage and a compressed position wherein the ceiling member is generally collapsed onto the floor member. The first connector is configured to support the ceiling member in a generally horizontal orientation when the first connector engages the support member.

In an implementation of the second embodiment, the compartment forms a generally flat assembly when in the compressed position.

In another implementation of the second embodiment, the first wall member and the second wall member are collapsible. In a variation of this implementation, the first wall member and the second wall member each comprise a fabric material.

In another implementation of the second embodiment, the floor member comprises a resilient second member. In a variation of this implementation, the first wall member and the second wall member comprise a fabric material. In a further variation, the first connector is attached to the ceiling member.

In another implementation of the second embodiment, the portable storage device further comprises a first retaining feature that is attached to an underside of the floor member. The first retaining feature comprises a generally planar body defining a channel that extends partially therethrough. The first retaining feature is configured to hang below the floor member when the first connector engages the fence.

In another implementation of the second embodiment, the portable storage device further comprises a pocket that is attached to an outside portion of one of the first wall member and the second wall member.

In another implementation of the second embodiment, the portable storage device further comprises a hook attached to an outside portion of one of the first wall member and the second wall member.

In another implementation of the second embodiment, the first connector comprises a strap having an adjustable length.

In a third embodiment, a portable storage device comprises a first compartment having a first floor member, a first ceiling member spaced apart from the first floor member, a first wall member attached to both the first floor member and the first ceiling member, and a second wall member attached to both the first floor member and the first ceiling member, the second wall member being spaced apart from the first wall member. The portable storage device further comprises a second compartment that is disposed adjacent the first compartment. The second compartment has a second floor member, a second ceiling member spaced apart from the second floor member, the second wall member being attached to both the second floor member and the second ceiling member, and a third wall member attached to both the second floor member and the second ceiling member. The third wall member is spaced apart from the second wall member. The portable storage device further comprises a first connector connected to one of the first compartment and the second compartment. The first connector is configured to be removably connected to a fence. The first ceiling member and the second ceiling member each comprise a resilient generally planar member and a fabric material at least partially surrounding the generally planar member. The first compartment and the second compartment can move between an expanded position to receive items for storage and a compressed position wherein the first ceiling member is generally collapsed onto the first floor member and the second ceiling member is generally collapsed onto the second floor member. The first connection is configured to support the first ceiling member and the second ceiling member in a generally horizontal orientation when the first connector engages the fence.

In an implementation of the third embodiment, the first floor member and the second floor member each comprise a resilient generally planar member and a fabric material at least partially surrounding the generally planar member.

In another implementation of the third embodiment, the first wall, the second wall and the third wall each comprise a fabric material.

BRIEF DESCRIPTION OF THE DRAWINGS

The description herein makes reference to the accompanying drawings wherein like reference numerals refer to like parts throughout the several views, and in which.

DETAILED DESCRIPTION OF THE PREFERRED EMBODIMENT(S)

Figure 1:
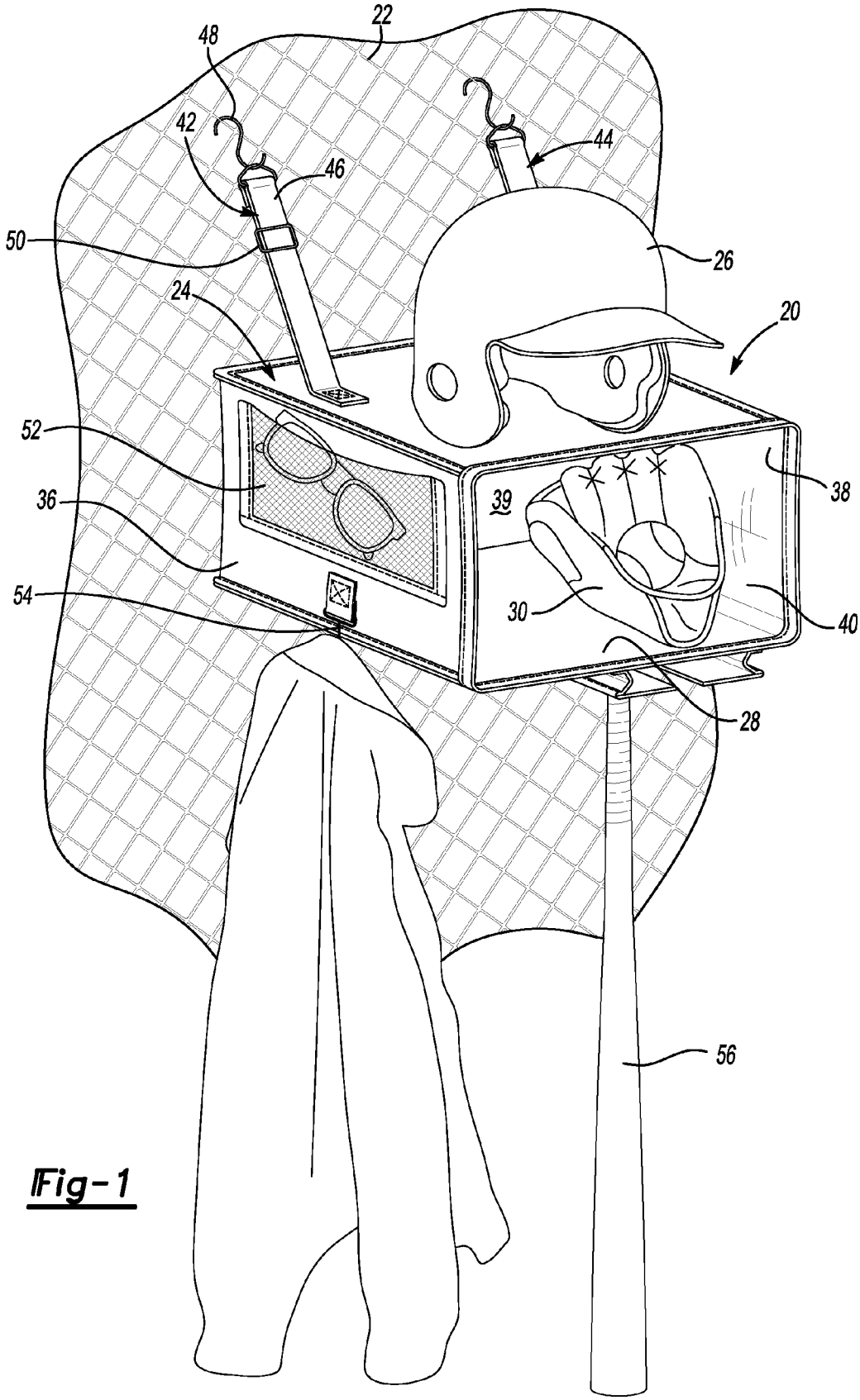
FIG. 1 is a perspective view illustrating an embodiment of a portable storage device of the present invention removably attached to a fence.

Detailed embodiments of the present invention are disclosed herein; however, it is to be understood that the disclosed embodiments are merely exemplary of the invention that may be embodied in various and alternative forms. The figures are not necessarily drawn to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Sports such as baseball, hockey, lacrosse, soccer and many others require the participants to use a variety of different equipment including bats, balls, sticks, mitts, hats, helmets, knee pads, wrist guards, gloves and much more. Arenas and sports venues where such sporting events are played, such as, but not limited to, a baseball diamond, may lack storage facilities or lockers for the players to temporarily store their equipment when not in use. Consequently, players may leave their sports paraphernalia on seating surfaces and the ground, typically in an area where the team is stationed during the game. An exemplary area is a dugout adjacent a baseball diamond. Baseball players leave their gloves, batting helmets and baseball bats on benches and on floor surfaces in the dugout. Storage of sporting equipment in such a disorganized manner can cause confusion when it is time for the players to take the field. Additionally, unsupervised the placement of such items as balls and bats, which are generally round and which can roll from whatever position they have been placed in to another, unintended position, can be hazardous. It would be advantageous to provide sports' players with a portable locker that can accommodate their sporting equipment.

Embodiments of the present invention address this problem by providing a small, lightweight, collapsible and portable sports locker or portable storage device. In at least one embodiment, the portable storage device is a compartment having a floor member and a ceiling member which are connected to one another by two, spaced apart, fabric walls. The ceiling member comprises a generally resilient planar member made from materials including plastic, plexiglass, fiberglass, Cintra, PVC, and HDP plastic. Surrounding the planar substrate is a sturdy fabric material such as, but not limited to, canvas, nylon, 600×300 denier polyester with PVC backing, 1000 denier nylon, 420 denier nylon, vinyl coated mesh, and 0.020 clear PVC. The walls connecting the ceiling member and the floor member, when made of a fabric material, can collapse or crumple when the floor member and the ceiling member are compressed together. Being configured to collapse makes it convenient to transport the portable storage device to and from sporting events by simply flattening the portable storage device and inserting it into whatever equipment bag the user typically brings with him to the sporting or other event.

In other embodiments, each wall member may include a plurality of generally resilient planar members that are hinged to fold as the ceiling member collapses onto the floor member. In other embodiments, two or more planar members may be sewn into or otherwise included in each wall member and disposed in a coplanar fashion such that there is a gap between individual planar members. In such embodiments, the fabric in which the planar members have been sewn will serve as a hinge to permit the wall members to fold.

The portable storage device includes an engagement feature that is configured to removably attach the portable storage device to a fence such as the type of cyclone fencing seen frequently at baseball diamonds. Typical engagement features include, but are not limited to, S-hooks and closable hooks. Such engagement features can easily attach to, and detach from a fence. The engagement feature may be attached through an outer portion of the ceiling member. The storage device hangs down from the attachment feature when the attachment feature is attached to a fence. Some embodiments may include a tether or strap leading from the ceiling member to the engagement feature. In some embodiments, these tethers or straps may be adjustable in length. Such an arrangement gives greater flexibility to players or users of the portable storage device in circumstances where fence space may be limited. Such straps or tethers may be attached to the fabric material of the ceiling member. In some embodiments, an additional strap may be sewn or otherwise attached to the fabric material of the ceiling to provide a reinforced foundation for the mounting of the engagement feature or the straps/tethers.

In other embodiments, where less equipment may be needed, or where a storage device having a lower profile is desired, the portable storage device may comprise only a shelf and an attachment feature. (The shelf corresponds to the ceiling member of the previously discussed embodiment). In such embodiments, the storage device would not have a compartment, but rather, only a single flat surface on which to support equipment and/or from which to hang equipment. A rear portion or edge of the shelf may be adapted for connection to the fence to cooperate with the engagement feature in supporting the shelf at a desired angle with respect to the ground. In other embodiments, the portable storage device may include a plurality of compartments to accommodate a plurality of players/users. Such compartments can be arranged either vertically or horizontally.

It should be understood that the portable storage device disclosed herein may be used for events and activities other than for sporting events. For instance, embodiments of the portable storage device of the present invention may be used at picnics, field days, and other social gatherings. It may also be used by workers such as construction workers who may need to travel to remote locations with a variety of different pieces and types of equipment. A greater understanding of the embodiments of the present invention may be obtained through a review of the detailed description below as well as a review of the Figures accompanying this disclosure.

With respect to FIG. 1, an embodiment of the portable storage device 20 of the present invention is illustrated in perspective view. Portable storage device 20 is removably attached to a fence 22. As illustrated, fence 22 is a cyclone-type fence. It should be understood that other types of fencing including, but not limited to, chain link fences and picket fences are equally compatible with the teachings of the present invention. Portable storage device 20 includes a ceiling member 24. Ceiling member 24 comprises an upper portion of portable storage device 20. When portable storage device 20 is attached to a fence such as fence 22, an outer or top surface of ceiling member 24 may serve as a shelf for the storage of items. For example, in the illustrated embodiment, a batting helmet 26 is sitting on top of ceiling member 24. Ceiling member 24 comprises a generally resilient substrate 32 (see FIG. 6) either partially or completely surrounded by a fabric material 34 (see FIG. 6). Use of resilient substrate 32 embedded within fabric material 34 to serve as ceiling member 24 provides some structural stability to portable storage device 20 and prevents the ceiling member from caving in when a heavy load, such as batting helmet 26, is placed thereon.

A floor member 28 comprises a bottom portion of portable storage device 20. The upper surface (from the perspective of FIG. 1) of floor member 28 can, like the upper surface of ceiling member 24, serve as a shelf for the storage of equipment such as sports equipment. For example, in the illustrated embodiment, a baseball glove 30 is illustrated sitting on a upper surface of floor member 28. In some embodiments, floor member 28 comprises a resilient substrate 32 and a fabric material 34 at least partially surrounding the resilient substrate to provide added structural stability to the portable storage device, thereby inhibiting deformation of portable storage device 20 when a load is supported by floor member 28. A first wall member 36 and a second wall member 38 connect floor member 28 to ceiling member 24. First wall member 36 and second wall member 38 are spaced apart from one another. First wall member 36 and second wall member 38 comprise a fabric material which permits floor member 28 and ceiling member 24 to collapse together for convenient storage of portable storage device 20.

The arrangement of ceiling member 24, floor member 28, and first and second wall members 36, 38 provides a compartment 40 in which to secure various items. In some embodiments, a back panel 39 connects ceiling member 24, floor member 28, first wall member 36 and second wall member 38 to form a five sided, open box. Such a back panel may comprise a fabric material and may be useful in circumstances where the items stored within compartment 40 are small enough to fall through any gap or opening formed in fence 22. In still other embodiments, a front panel (not shown) may be provided to close the front portion of compartment 40, thereby forming a six sided box. Such a front panel may be useful in circumstances where a generally horizontal disposition of portable storage device 20 cannot be obtained and there is a danger that loose articles supported on floor member 28 may fall out of compartment 40. Such a front panel may also be useful to provide a secure environment in which to store valuable personal articles by providing concealment for such articles, and also to provide general protection from the elements such as wind, rain and snow. Portable storage device 20 may be configured to receive a back panel and a front panel such as by providing a zipper around a perimeter of a front and rear portion of compartment 40 or by providing hook and loop receivers at various locations around a perimeter of the front and rear portion of compartment 40.

Attached to an upper or top portion of ceiling member 24 are first and second engagement members 42 and 44. In the illustrated embodiment, first engagement feature 42 comprises a strap 46 and an S-hook 48. A buckle 50 is provided to permit a user to increase and decrease the length of strap 46. S-hook 48 permits generally secure attachment to fence 22 while ensuring an easy disengagement when it is time to depart. In other embodiments, a closable hook may be used with first and second engagement features 42, 44 to provide a more secure attachment to fence 22 (see FIGS. 7 and 8). In still other embodiments, other means of removably attaching portable storage device 20 may be employed, including, but not limited to, all types of hooks, tethers, ties, and hook and loop type fasteners such as Velcro™. First and second engagement features 42, 44 are attached to the fabric material 34 of ceiling member 24. In some embodiments, first and second engagement features 42, 44 may be sewn together with fabric material 34 while in other embodiments, an adhesive may be used to conjoin first and second engagement features 42, 44 with ceiling member 24. In still other embodiments, a reinforcing strap 57 (see FIGS. 2-4) may be attached to ceiling member 24 and first and second engagement features 42, 44 may be secured to reinforcing strap 57.

Portable storage device 20 may be equipped with a pouch 52 and a hook 54 to permit a user to secure either delicate or bulky items. For example, pouch 52 may permit a user to separately store sunglasses. Such separate storage may be desirable to prevent damage to the sunglasses or other item(s) from other equipment that may be stored within compartment 40. In other embodiments, pouch 52 may be attached to internal surfaces of first and second wall members 36, 38. Furthermore, a user may prefer to hang a coat or other item of apparel on hook 54 rather than to fold or crumple such garment for storage in compartment 40. Portable storage device 20 may also be configured to permit secure and readily accessible storage for specific pieces of equipment such as baseball bat 56, discussed below.

Figure 2:
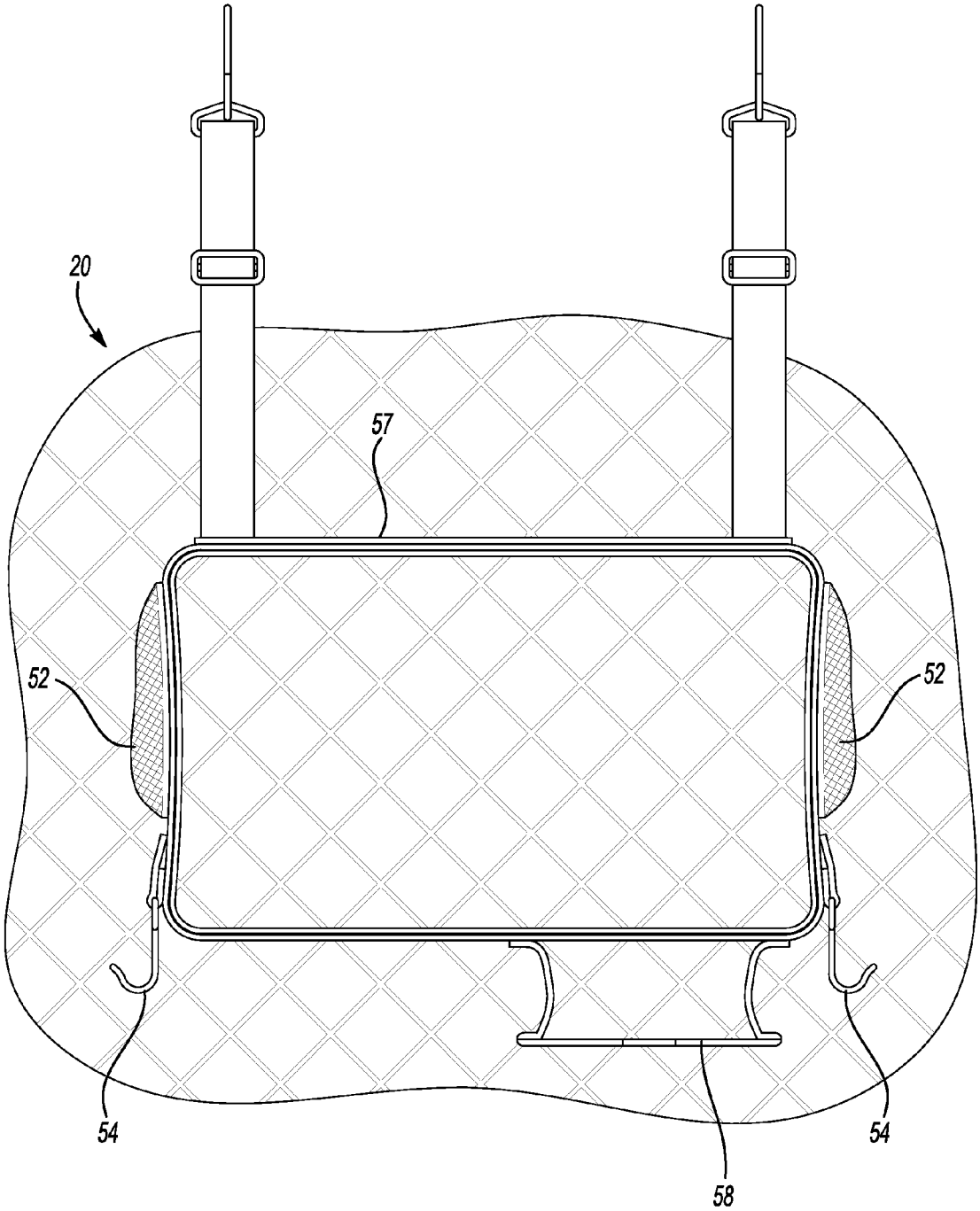
FIG. 2 is a front view of another embodiment of the portable storage device of FIG. 1.

With respect to FIG. 2, a front view looking into an interior portion of portable storage device 20 is illustrated. As illustrated, portable storage device 20 may be outfitted with a plurality of pouches 52 and a plurality of hooks 54. In this view, retaining feature 58, which supported baseball bat 56 illustrated in FIG. 1, is shown. Retaining feature 58 will be discussed in greater detail below.

Figure 3:
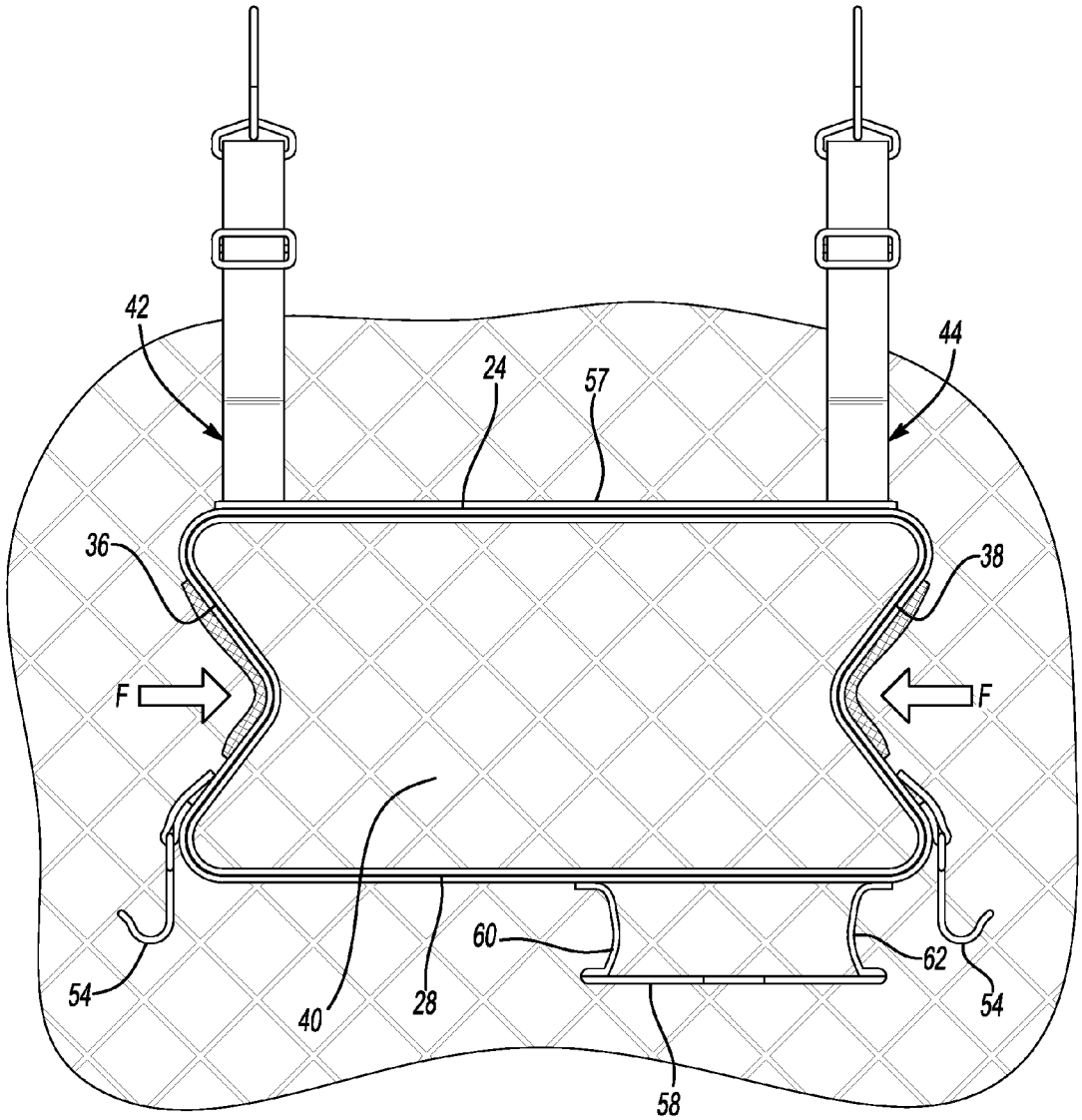
FIG. 3 is a front view of the portable storage device of FIG. 2 as the portable storage device begins to collapse.
Figure 4:
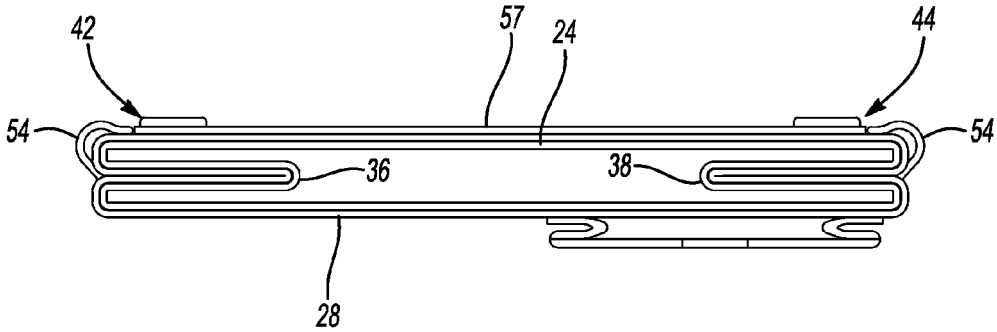
FIG. 4 is a front view illustrating the portable storage device of FIG. 2 in a collapsed condition ready for transport.

With respect to FIGS. 3 and 4, these front views illustrate the movement of compartment 40 between an expanded position (see FIG. 2) and a compressed position (see FIG. 4). In FIG. 3, a force F is applied inwardly to first wall member 36 and second wall member 38. Force F may be applied either substantially simultaneously or sequentially. The application of force F to the first and second wall members 36, 38 cause them to fold inwardly into compartment 40. As first and second wall members 36 and 38 fold in half, floor member 28 and ceiling member 24 move towards one another, collapsing compartment 40. In other embodiments, wherein first wall member 36 and second wall member 38 consist only of fabric material (i.e., no substrate), rather than folding, first and second wall members 36, 38 may simply crumple or otherwise compress. In still other embodiments, it may be desirable to apply force F outwardly on first wall member 36 and second wall member 38 to cause them to fold outwardly from compartment 40. Applying force F in this manner will result in a flatter, longer folded portable storage device 20.

Retaining feature 58 is attached to an underside of floor member 28 by first and second flaps 60, 62. First and second flaps 60, 62 comprise a fabric material and permit the folding of retaining feature 58 against floor member 28. As illustrated in FIG. 4, compartment 40 has moved to a compressed position and portable storage device 20 comprises a substantially flat, transportable assembly. To move compartment 40 to its expanded position, a user need only pull floor member 28 and ceiling member 24 away from one another. This action will extend first and second wall members 36, 38.

Figure 5:
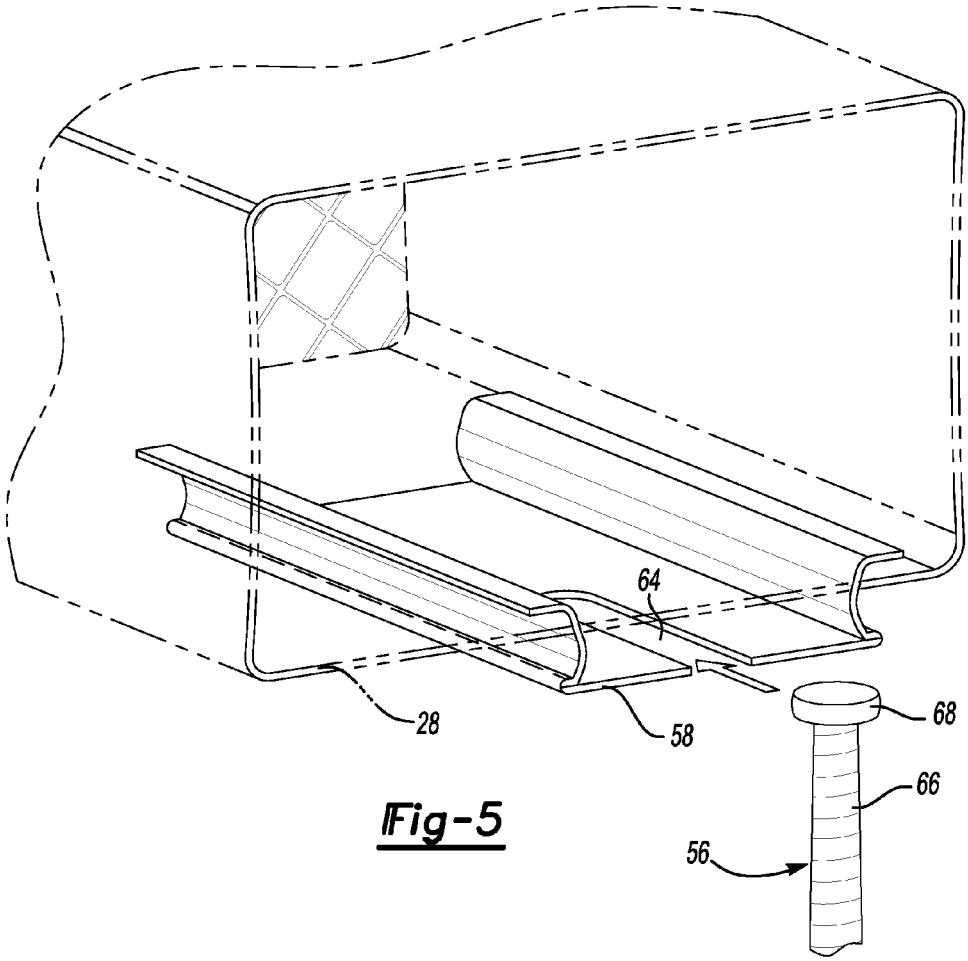
FIG. 5 is a perspective view illustrating a retaining feature configured to receive and retain the handle portion of a baseball bat.

With respect to FIG. 5, an expanded view illustrating retaining feature 58 is depicted in perspective view. As illustrated, retaining feature 58 comprises a substantially planar member having a channel 64 extending therethrough. Channel 64 has a width that exceeds the width of handle 66 of baseball bat 56 but which is less wide than cap 68. This permits baseball bat 56 to be slid at its handle 66, into channel 64 and released. Cap 68 cannot fit through channel 64 and thus retaining feature 58 is able to support baseball bat 56 in a suspended orientation beneath floor member 28. Depending on the length of channel 64, one or more baseball bats may be supported by retaining feature 58. In other embodiments, a plurality of retaining features 58 may be attached to an underside of floor member 28 to permit supporting a plurality of baseball bats, anyone of which may be individually removed without needing to disturb any of the others. Although not illustrated, it should be understood by those of ordinary skill in the art that retaining feature 58 can be adapted to accommodate a wide variety of sporting equipment and its illustrated use here with baseball bat 56 is merely exemplary.

Figure 6:
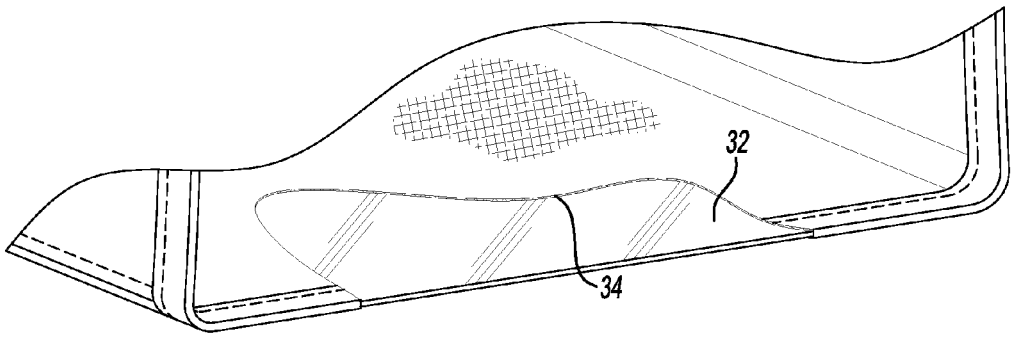
FIG. 6 is a cut away perspective view illustrating a floor member of the portable storage device of FIG. 1 with a portion of the outer material torn away to illustrate the substrate.

With respect to FIG. 6, a cut away, perspective view of floor member 28 is illustrated. Floor member 28 comprises a resilient substrate 32 extending throughout substantially the entire floor member 28. Resilient substrate 32 is encased within fabric material 34. The use of a resilient substrate together with a fabric outer casing provides both the strength to support heavy objects and resistance to wear and tear as typically accompanies the repetitive movement in and out of sporting equipment or other items. Ceiling member 24 may be constructed in a substantially identical fashion.

In other embodiments, ceiling member 24, floor member 28, first wall member 36, and second wall member 38 may consist of resilient substrates without fabric coverings. In such embodiments, the ends of such substrates can be conjoined with hinges, first and second wall members having centrally mounted hinges to permit them to fold flat which will, in turn, permit the floor member and ceiling member to be collapsed together.

Figure 7:
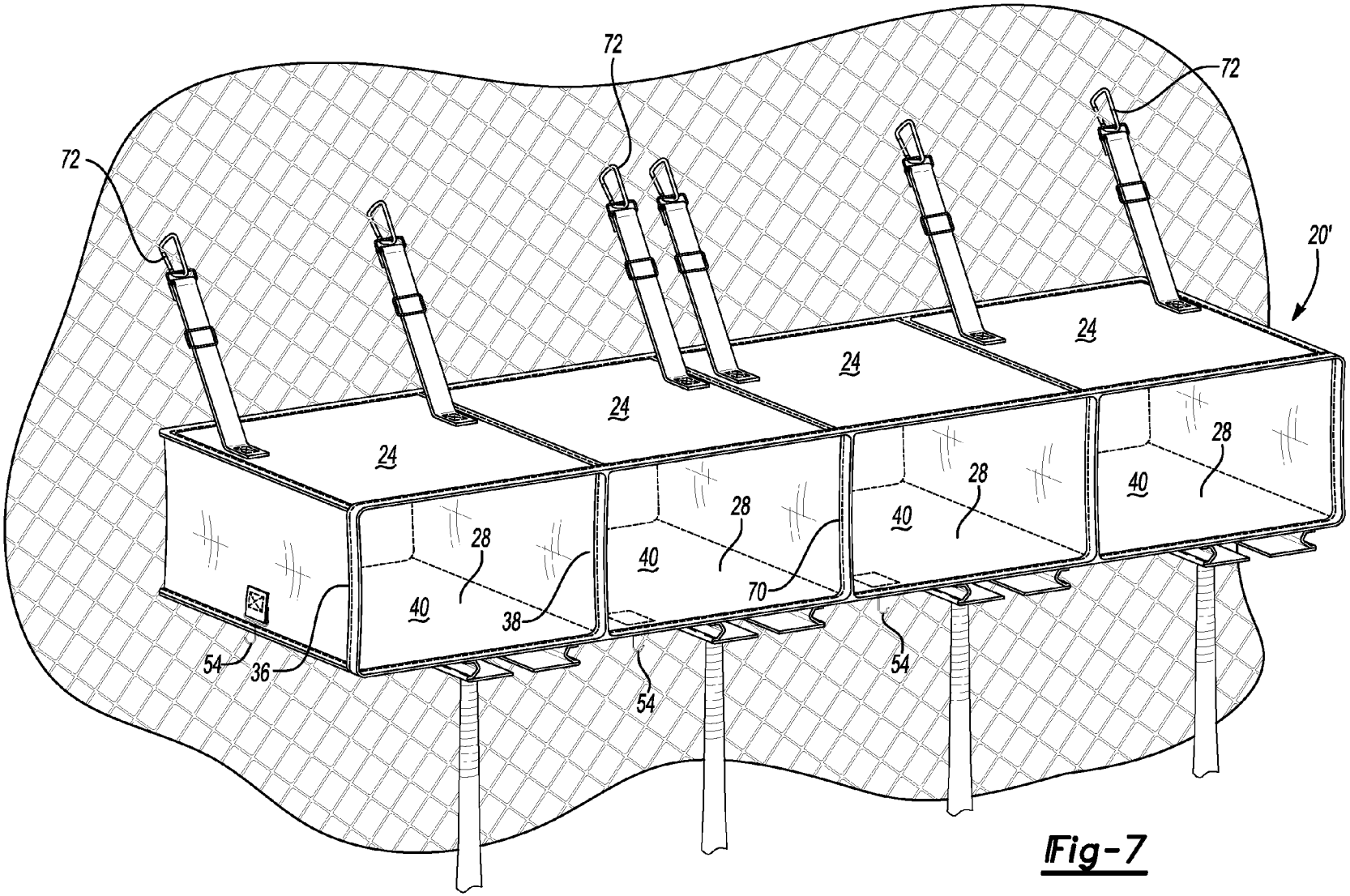
FIG. 7 illustrates an alternate embodiment of the portable storage device of the present invention configured to accommodate a plurality of users.

With respect to FIG. 7, an alternate embodiment of portable storage device 20' is illustrated. In this embodiment, portable storage device 20' comprises a plurality of compartments 40. As before, each compartment is formed by a floor member, a ceiling member, and two wall members. For instance, the compartment 40 disposed on the left side of portable storage device 20' comprises ceiling member 24, floor member 28, first wall member 36 and second wall member 38. The adjoining compartment 40 also includes a ceiling member 24, a floor member 28, a third wall member 70 and also utilizes second wall member 38. This configuration, where two adjoining compartments share a single wall, provides a cost benefit to a manufacturer in that fewer materials are needed to provide storage space to a plurality of users. Unlike portable storage device 20, which, in FIG. 1 is depicted with S-hooks 48, portable storage device 20' includes closable hooks 72. Closable hooks comprise a closed loop with a hinged member that is biased against an opposite end of the closed loop. If sufficient force is applied to the closing member in opposition to the bias, the closing member can be moved out of position to allow an item, such as a portion of a fence, to be disposed within the loop of closable hook 72. It should be understood by those of ordinary skill in the art that closable hook 72 and S-hooks 48 may be used interchangeably.

Figure 8:
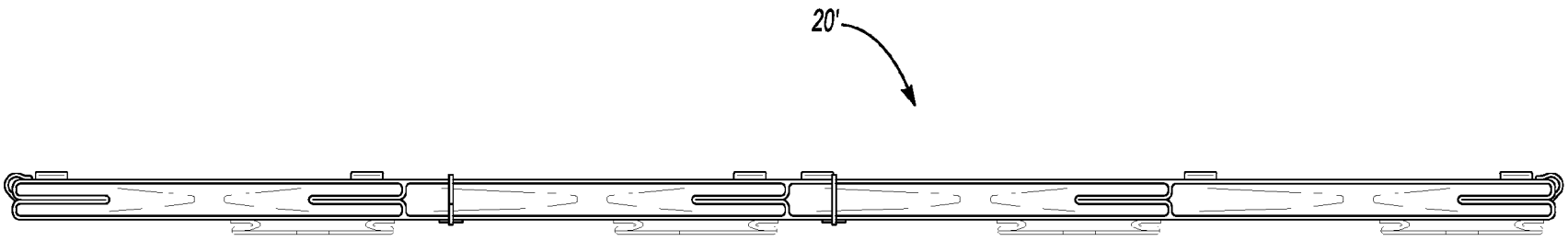
FIG. 8 illustrates the portable storage device of FIG. 7 in a collapsed state.

With respect to FIG. 8, portable storage device 20' is illustrated with its respective four compartments disposed in their compressed position.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A portable storage device comprising:

a compartment having a floor member, a ceiling member spaced apart from the floor member, a collapsible first wall member attached to both the floor member and the ceiling member, and a collapsible second wall member attached to both the floor member and the ceiling member, the second wall member being spaced apart from the first wall member;

a first connector connected to the compartment, the first connector being configured to be removably connected to a support member; and a bat holder attached to an underside of the floor member, the bat holder configured to hang below the floor member and be capable of holding a bat when the first connector engages the support member;

wherein the first and second collapsible wall members enable the storage device to be capable of moving to compressed position wherein the ceiling member is generally adjacent the floor member, and wherein the first connector is configured to support the ceiling member when the first connector engages the support member.

2. The portable storage device of claim 1 wherein the compartment forms a generally flat assembly when in the compressed position.

3. The portable storage device of claim 2 wherein the first wall member and the second wall member each comprise a fabric material.

4. The portable storage device of claim 1 wherein the floor member comprises a resilient second member.

5. The portable storage device of claim 4 wherein the first wall member and the second wall member comprise a fabric material.

6. The portable storage device of claim 5 wherein the first connector is attached to the ceiling member.

7. The portable storage device of claim 1 further comprising a pocket attached to an outside portion of one of the first wall member and the second wall member.

8. The portable storage device of claim 1 further comprising a hook attached to an outside portion of one of the first wall member and the second wall member.

9. The portable storage device of claim 1 wherein the first connector comprises a strap having an adjustable length.

10. The portable storage device of claim 1 wherein the bat holder comprises a generally planar body defining a slot partially extending through the body.

11. The portable storage device of claim 10 wherein the generally planar body has a front surface, a rear surface, a top face, and a bottom face, wherein the slot extends from the front surface towards the rear surface and between and connecting the top face and the bottom face.

12. The portable storage device of claim 11 wherein the slot has a width that is greater than the width of a baseball bat handle and less than the width of a baseball bat cap, such that the cap can rest on the top face of the generally planar body and the handle extends through the slot and below the bottom face of the generally planar body.

13. The portable storage device of claim 11 wherein a plurality of collapsible flaps connect the retaining feature to the underside of the floor member.

14. The portable storage device of claim 10 wherein the generally planar body has a front surface, a rear surface, a top face, and a bottom face, wherein the slot extends from the front face towards the rear face, the slot having a thickness equal to the thickness of the generally planar body.

15. The portable storage device of claim 10 wherein the slot is a cut-out portion of the generally planar body.

16. A portable storage device comprising:

a first compartment having a first floor member, a first ceiling member spaced apart from the first floor member, a collapsible first wall member attached to both the first floor member and the first ceiling member, and a collapsible second wall member attached to both the first floor member and the first ceiling member, the second wall member being spaced apart from the first wall member;

a second compartment disposed adjacent the first compartment, the second compartment having a second floor member, a second ceiling member spaced apart from the second floor member, the second wall member being attached to both the second floor member and the second ceiling member, and a collapsible third wall member attached to both the second floor member and the second ceiling member, the third wall member being spaced apart from the second wall member; and a first connector connected to the first compartment and a second connector connected to the second compartment, the first and second connectors being configured to be removably connected to a chain link fence; and a bat holder attached to an underside of each of the first and second floor being configured to hang below each floor member and being capable of holding a bat when the first connector engages the support member;

wherein the collapsible wall members enable the first compartment and the second compartment to be compressed so that the first ceiling member is generally adjacent the first floor member and the second ceiling member is generally adjacent the second floor member, and wherein the first and second connectors support the first ceiling member and the second ceiling member when the first and second connectors engage the fence.

17. The portable storage device of claim 16 wherein the first floor member, the first ceiling member, the second floor member, and the second ceiling member each comprise a resilient, generally planar member and a fabric material at least partially surrounding the generally planar member.

18. The portable storage device of claim 16 wherein the first wall, the second wall and the third wall each comprise a fabric material.

19. A portable storage device for storing sports equipment, the storage device comprising:

a storage compartment defined by a floor, a ceiling spaced a first distance from the floor, and a pair of spaced side walls, the side walls extending between the floor and the ceiling and being more flexible than the floor and the ceiling;

a first connector connected to the storage compartment, the first connector being configured to be removably connected to a chain link fence; and a bat retaining compartment disposed below the storage compartment, the bat retaining compartment defined by:

a member spaced from the floor, the member having a top surface, a bottom surface, a front surface, and a rear surface, the member further having a slot surface extending between the top and bottom surfaces and connecting the top and bottom surfaces, the slot surface extending from the front surface towards the rear surface, the slot surface defining a slot extending from the front surface towards the rear surface; and a plurality of flaps being more flexible than the member, the flaps attaching the member to an underside of the floor;

wherein the side walls and the flaps can fold to enable the ceiling and the retaining member to move from their spaced apart relationship with the floor to a relationship second distance closer than the first distance, thereby compressing the storage compartment and the bat retaining compartment.

20. A portable athletic equipment storage device comprising:

a compartment having a floor, a ceiling spaced a first distance from the floor; a collapsible first wall attached to both the floor and the ceiling, and a collapsible second wall attached to both the floor and the ceiling, the second wall being spaced from the first wall;

a hook connected to the compartment, the hook being configured to be removably connected to a chainlink fence; and a bat holder attached to an underside of the floor, the bat holder having a top face, a bottom face, a front surface, and a rear surface, the bat holder having a slot extending from the front surface towards the rear surface, the bat holder being configured to hang below the floor and being capable of holding a bat when the hook engages the fence;

wherein the first and second collapsible walls enable the storage device to be capable of moving to a compressed position wherein the ceiling is spaced a second distance from the floor, the second distance being less than the first distance, and wherein the hook is configured to support the ceiling when the hook engages the fence.

* * * * *

UNITED STATES PATENT AND TRADEMARK OFFICE

CERTIFICATE OF CORRECTION

PATENT NO. : 7,841,467 B2
APPLICATION NO. : 12/364627
DATED : November 30, 2010
INVENTOR(S) : John Slayton It is certified that error appears in the above-identified patent and that said Letters Patent is hereby corrected as shown below:

Column 10, Line 64, Claim 19:

After "floor to a" delete "relationship".

Signed and Sealed this
Eighth Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,841,467 B2
APPLICATION NO. : 12/364627
DATED : November 30, 2010
INVENTOR(S) : John Slayton It is certified that error appears in the above-identified patent and that said Letters Patent is hereby corrected as shown below:

Column 10, Line 20, Claim 16,

After "second floor" insert -- members, each bat holder --.

Signed and Sealed this
Fifteenth Day of March, 2011

David J. Kappos

David J. Kappos
*Director of the United States Patent and Trademark Office*